US005161968A

United States Patent [19]

Nutcher et al.

[11] Patent Number: 5,161,968

[45] Date of Patent: Nov. 10, 1992

[54] REGENERATIVE THERMAL OXIDIZER

[75] Inventors: Peter B. Nutcher, Bridgeville; Peter J. Waldern, Bethel Park, both of Pa.

[73] Assignee: Process Combustion Corporation, Pittsburgh, Pa.

[21] Appl. No.: 703,509

[22] Filed: May 21, 1991

[51] Int. Cl.[5] ..... F27D 17/00

[52] U.S. Cl. ..... 432/179; 432/181; 110/235

[58] Field of Search ..... 432/180, 181, 179; 110/235

[56] References Cited

U.S. PATENT DOCUMENTS

| | | | |
|---|---|---|---|
| 1,940,371 | 12/1933 | Royster | 257/6 |
| 3,211,534 | 10/1965 | Ridgway | 23/277 |
| 3,634,026 | 1/1972 | Kuechler et al. | 23/277 |
| 3,870,474 | 3/1975 | Houston | 23/277 |
| 3,895,918 | 7/1975 | Mueller | 23/277 |
| 4,302,426 | 11/1981 | Benedick | 422/173 |
| 4,435,152 | 3/1984 | Struck et al. | 431/170 |
| 4,454,826 | 6/1984 | Benedick | 110/211 |
| 4,474,118 | 10/1984 | Benedick | 110/211 |
| 4,528,012 | 7/1985 | Sturgill | 432/180 |
| 4,793,974 | 12/1988 | Hebrank | 422/175 |
| 4,840,560 | 6/1989 | Waddington | 432/59 |
| 4,850,862 | 7/1989 | Bjerklie | 432/181 |
| 4,874,311 | 10/1989 | Gitman | 432/13 |
| 4,898,530 | 2/1990 | Wills et al. | 432/181 |
| 4,944,670 | 7/1990 | Watson | 432/181 |
| 4,957,430 | 9/1990 | Goodfellow | 432/181 |

OTHER PUBLICATIONS

Procter and Schwartz, Inc. publication Bulletin 533 Jan. 1971.

*Primary Examiner*—Henry C. Yuen

*Attorney, Agent, or Firm*—Webb, Burden, Ziesenheim & Webb

[57] ABSTRACT

An apparatus having an incineration chamber and at least one burner for oxidizing fumes is provided. First and second regenerators are in fluid communication with the incineration chamber, as is a bypass which introduces unburnt fumes to the incineration chamber without passing them through either of the regenerators. While the fumes are in the bypass, a purging device, including a purge fan and accompanying conduits and valves, introduces a purge gas to either one of the regenerators to force unburnt fumes therefrom. The purged fumes and the purge gas are mixed with the incoming fumes from the bypass in an annular plenum downstream of the purged regenerator before they are introduced to the incineration chamber for oxidation. The flow of incoming fumes to the system may be continuous, even during purging, and the purge fan may also be continuously operated.

7 Claims, 3 Drawing Sheets

REGENERATIVE THERMAL OXIDIZER

BACKGROUND OF THE INVENTION

1. Field of the Invention

This invention relates to regenerative incinerators for thermally oxidizing contaminated fumes and, more particularly, to incinerators which have means for purging contaminated fumes from their regenerators.

Incinerators are frequently employed to destroy harmful emissions resulting from various processes. Frequently, incinerators are used to oxidize light hydrocarbon emissions. For example, the finishing line on an aluminum strip coating process may emit toluene, which is directed with the finishing line exhaust to a downstream incinerator where toluene and other harmful emissions are oxidized at high temperatures. The incinerator exhaust is then suitable for introduction to the atmosphere, or it may be recycled to meet other plant energy needs. Incinerators are also applied in conjunction with food processing to control odors, pharmaceutical and fragrance manufacturing, painting and printing and many other applications.

Thermal regenerators, including beds of ceramic materials, may be included in the incinerator design. The regenerative beds greatly increase the overall thermal efficiency of the incinerator (as high as 95%), reducing annual fuel costs and maximizing contaminant destruction rates within the incinerator. The contaminated fumes are typically raised to temperatures of 1,200° F. to 2,200° F. within the regenerator before being introduced to the incinerator. The main problem with regenerators is that contaminated fumes are left within the regenerative bed when flow through the system is reversed and the bed is switched from the preheating mode to the exhaust mode. There is a risk that these contaminants may be emitted into the atmosphere with incinerator exhaust.

2. Description of the Prior Art

The prior art has generally addressed the problem of residual contaminants by including a purging means with the incinerator to force contaminated fumes from the bed while the bed is between preheating and exhaust cycles. For example, U.S. Pat. No. 3,870,474 to Houston provides a purging means for a system having three regenerators. A first regenerator preheats contaminated fumes prior to incineration while a second regenerator receives and extracts heat from products of incineration. A third regenerator at the same time receives a purge of treated or purified air to force any untreated or contaminated fumes from the regenerator into the incineration chamber. In another form, this system has two regenerators, and a vacuum surge tank is in fluid communication with each regenerator. When flow in the system is reversed, the vacuum surge tank is placed in fluid communication with the appropriate regenerator by a four-way valve and a surge tank valve, and the contaminants within the regenerator are drawn into the surge tank. The contaminants are then evacuated from the surge tank by a vacuum pump, which places the contaminants back into the contaminant inlet.

There are several problems with the vacuum design. First, the vacuum system presents a risk of emitting untreated, contaminated fumes to the atmosphere when the regenerative cycle in the incinerator is reversed. The four-way valve which controls the flow of incoming contaminants and outgoing exhaust must be in perfect synchronization with the valve which admits contaminants into the surge tank. If the surge tank valve is opened an instant later than the reversal of flow, a small amount of contaminants will be emitted through the vent to the atmosphere. Over extended periods of time, this could amount to substantial volumes of untreated fumes exhausted to the atmosphere.

Second, repeated application of a strong vacuum to the entire system substantially decreases the useful life of various parts of the system, especially the valves. Particularly, the surge tank valve and a flap valve on the exhaust vent would require exceptional durability standards. Finally, the purging means, namely the vacuum surge tank, the surge tank valve and the vacuum pump, present added maintenance requirements and initial installation costs, and they may also be problematic in situations where overall system weight is a concern, such as rooftop installations.

Further regenerative incinerator designs may be seen in U.S. Pat. Nos. 4,874,311; 4,650,414; 4,474,118; 4,454,826; 4,302,426; 3,895,918; 3,634,026; 3,211,534 and 1,940,371. Additionally, a publication by Proctor and Schwartz, Inc., dated 1971, discloses a regenerative air purification system having two regenerators and a purge valve, which opens briefly to flush residual contaminated gas into the purification chamber. The disadvantage with this system is that the flow of incoming contaminated fumes must be completely halted while purging is taking place. This may require fans for the contaminated fumes and the purge gas to be frequently stopped and started, and it may also include further undesirable complications for the upstream system from which the contaminants originate.

It is therefore an object of the present invention to provide a regenerative incinerator having purging means which do not result in emission of untreated contaminants to the atmosphere when the purging means are activated. It is a further object to provide a regenerative incinerator with purging means that are relatively compact, lightweight and suitable for rooftop installations. It is a still further object to provide a regenerative incinerator having purging means which require low maintenance and which may be continuously operated to avoid frequent stops and starts and to avoid placing frequent sudden stresses on the overall system. Finally, it is an object of the present invention to provide a regenerative incinerator with a plenum for thoroughly mixing contaminated gases with purge gas and for introducing the mixture to an incineration chamber in a manner that ensures maximum destructive efficiency of the incinerator system.

SUMMARY OF THE INVENTION

Accordingly, we have developed an apparatus for oxidizing fumes having an incineration chamber and at least one burner directed into the incineration chamber. A first regenerator is in fluid communication with the incineration chamber, as is a second regenerator. The first regenerator preheats unburnt fumes prior to oxidization while the second regenerator extracts heat from oxidized fumes in a first cycle. In a second cycle, flow through the system is reversed and the second regenerator preheats unburnt fumes while the first regenerator extracts heat from oxidized fumes.

A bypass is in fluid communication with the incineration chamber for introducing unburnt fumes to the incineration chamber during a purge cycle, which is intermediate of the first and second cycles. The bypass introduces fumes to the incineration chamber without passing the fumes through either of the first or second regenerators. Means are included for selectively directing the unburnt fumes either into the bypass during the purge cycle or into the first or second regenerator during the first or second cycle, respectively. During the purge cycle, a purging device introduces a purge gas to either one of the first or second regenerators to purge unburnt fumes therefrom. The unburnt fumes are then directed to the incineration chamber for oxidation.

The burner may also include a concentric duct in fluid communication with the incineration chamber and a concentric port block which is intermediate the duct and the incineration chamber. An annular plenum having a plurality of apertures radially spaced from the longitudinal axis of the burner is in fluid communication with the incineration chamber. The apertures are coterminus with the port block, and the burner and plenum are also in fluid communication with both the bypass and either one of the first or second regenerators. The ratio of the combined cross-sectional areas of the apertures to the cross-sectional area of the burner duct may be approximately 40:1, so that approximately 97.5% by volume of the unburnt fumes introduced to the incineration chamber from either the bypass or the regenerators will pass through the apertures in the plenum, while approximately 2.5% will pass through the burner. The plenum and burner may be lined with refractory insulating material.

The purging device preferably includes at least two conduits, each conduit in fluid communication with one of the regenerators, and at least one valve. The valve selectively directs purge gas to either one of the two conduits. The purging device also includes a purge fan which is in fluid communication with the two conduits and an exhaust. The purge fan may be continuously operated throughout the first, purge and second cycles.

A method for oxidizing fumes in an incineration chamber having a first cycle followed by a purge cycle and a second cycle is also provided. Unburnt fumes are first introduced to an inlet and then directed to a first regenerator for preheating. The preheated unburnt fumes are then oxidized in the incineration chamber and directed to a second regenerator, where heat is extracted from the oxidized fumes.

After a predetermined period of time, the incoming unburnt fumes are diverted into a bypass, placing the unburnt fumes directly downstream of the first regenerator without passing them through the first regenerator. A purge gas is then introduced to the first regenerator to purge unburnt fumes therefrom and to preheat the purge gas. The preheated purge gas is mixed with the unburnt fumes downstream of the first regenerator, and the mixture is then introduced to the incineration chamber for oxidation. Thus, the flow of incoming unburnt fumes to the incinerator system is continuous with no loss of untreated fumes to the atmosphere.

After the unburnt fumes have been completely purged from the first regenerator, the incoming unburnt fumes are again diverted from the bypass to the second regenerator for preheating. The flow in the system is thereby reversed so that the fumes preheated in the second regenerator are then oxidized in the incineration chamber, and the oxidized fumes are directed to the first regenerator where their heat is extracted.

Further aspects and advantages of the present invention will be apparent from the following detailed description in conjunction with the accompanying drawings.

DETAILED DESCRIPTION OF THE PREFERRED EMBODIMENTS

Figure 1:
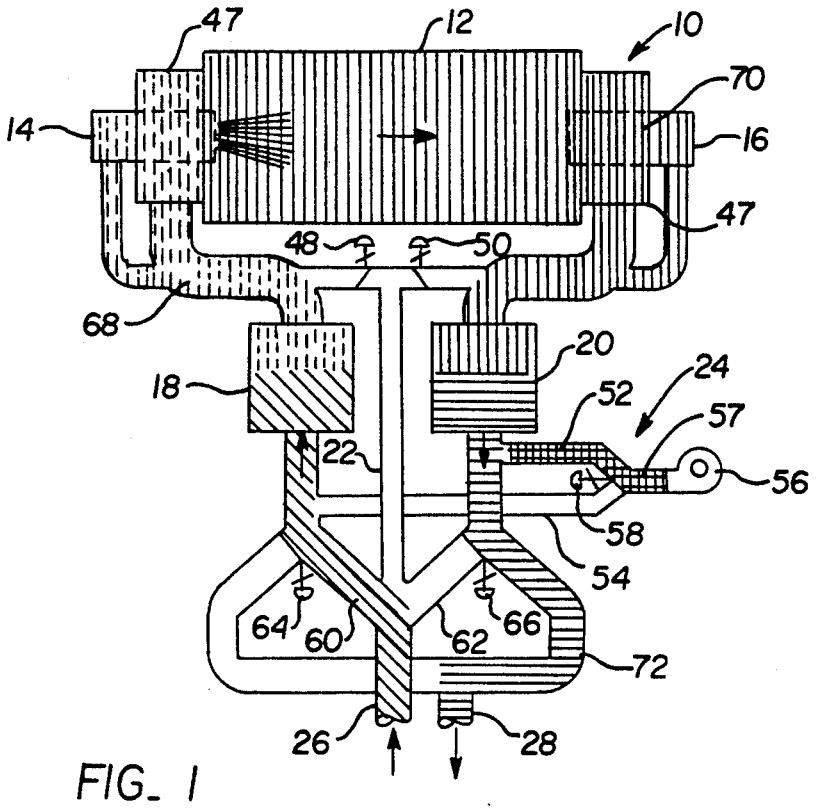
FIG. 1 is a schematic view of a regenerative incineration system operating in a first cycle in accordance with the present invention.

FIG. 1 shows an apparatus 10 for oxidizing fumes which has an incineration chamber 12 with a pair of burners 14, 16 directed into the incineration chamber 12. A pair of regenerators 18, 20 are associated with the burners 14, 16 and are in fluid communication with the incineration chamber 12. A bypass 22 is also in fluid communication with the incineration chamber 12 to introduce unburnt fumes 60 to the incineration chamber without passing them through either of the regenerators 18, 20. A purging device 24 purges unburnt fumes from the regenerators 18, 20 prior to reversal of flow through the apparatus 10. While each of the regenerators 18, 20 is being purged, the fumes previously passing through that regenerator are diverted to the bypass 22 and introduced into the incineration chamber 12. This ensures that the flow of incoming fumes 60 through an inlet 26 of the apparatus 10 may be constant and that no unburnt fumes will escape from the apparatus 10 through an exhaust 28 into the atmosphere during purging.

Figures 5, 6:
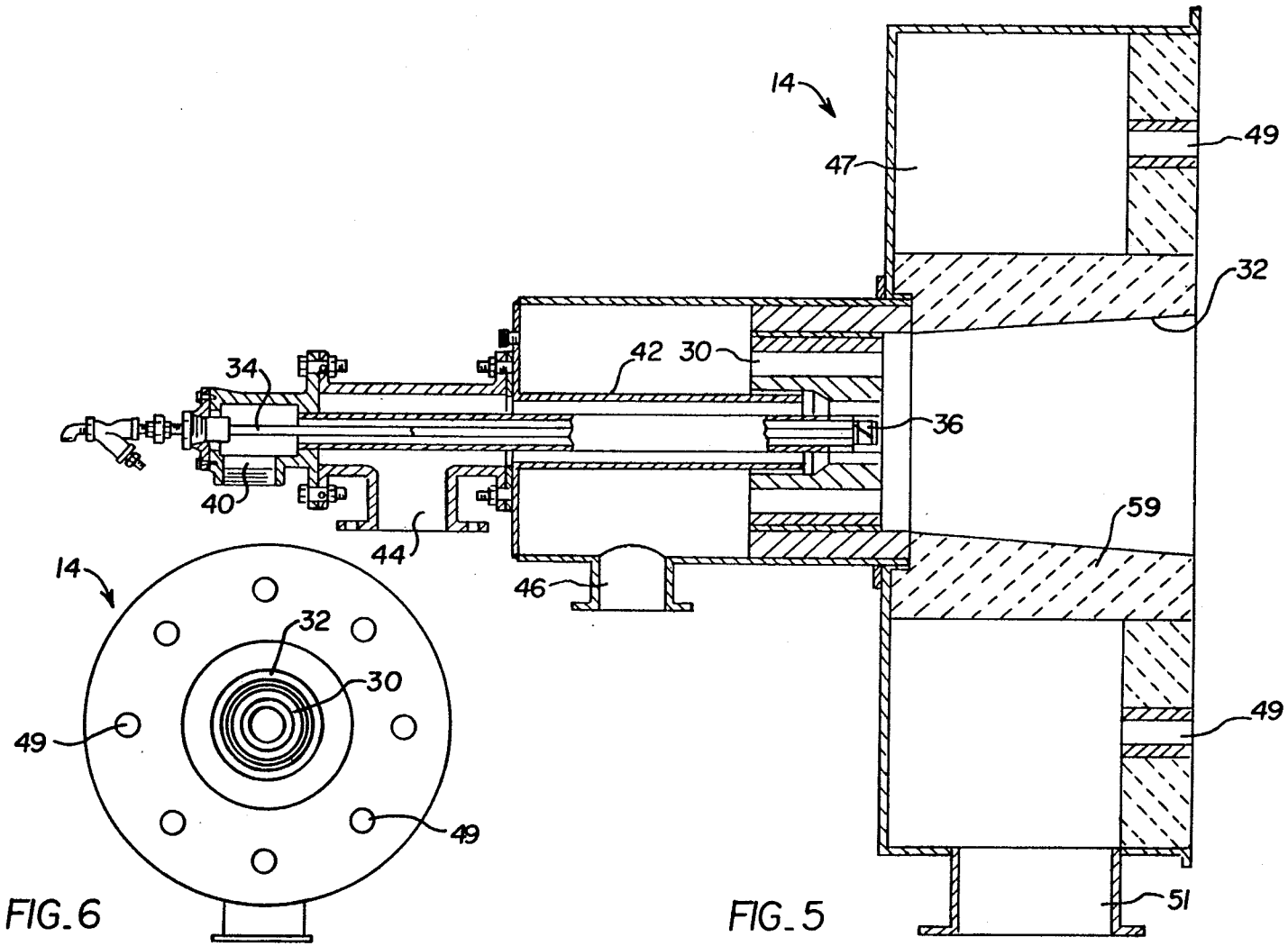
FIG. 5 is a cross-section of a burner having an annular plenum in accordance with the present invention.
FIG. 6 is a front view of the burner of FIG. 5.

Specifically, the incineration chamber 12 is lined with a fibrous ceramic material (not shown), and it is generally sized to accommodate a throughput of, for example, 10,000 cubic feet per minute. Referring to FIG. 5, the first burner 14 has a concentric duct 30 and a port block 32 which is intermediate the duct 30 and the incineration chamber 12. A fuel line 34 terminates in a nozzle 36 adjacent the upstream end of the port block 32. A fuel line sleeve 38 receives a pilot air/gas mixture, which is admitted through a pilot inlet 40. A cooling sleeve 42 encloses the fuel line sleeve 38, with cooling air admitted through a cooling inlet 44. A duct inlet 46 admits a first portion of the incoming fumes into the duct 30. The burner 14 is sized to accommodate a maximum fuel rate of one million BTUs per hour with a corresponding combustion air requirement of 250 cubic feet per minute. The structure and sizing of the second burner 16 is identical to that for the first burner 14.

Each burner 14, 16 also includes an annular plenum 47 which is concentric with the duct 30 and the port block 32. The plenum 47 has a plurality of apertures 49 radially spaced from the longitudinal axis of the burner 14. The apertures 49 place the plenum 47 in fluid communication with the incineration chamber 12, and they are coterminus with the port block 32. The plenum 47 also has a plenum inlet 51 for receiving a second portion of the incoming fumes. Apertures 49, duct 30 and a pair of downstream lines 53, 55 which append from the duct inlet 46 and the plenum inlet 51 should be sized to provide adequate combustion air to the burner without "flame-out", with the excess fumes and combustion air passing through the plenum. For example, the ratio of the sum of the cross-sectional areas of the apertures 49 to the cross-sectional area of the duct 30 may be approximately 40:1, so that approximately 97.5% by volume of the unburnt fumes and oxygen introduced to the incineration chamber 12 will pass through the plenum 47, and approximately 2.5% will pass through the burner. Finally, the plenums 47 and the burners 14, 16 may have a lining 59 of refractory material.

Referring back to FIG. 1, each burner 14, 16 has an associated regenerator 18, 20 in fluid communication with the burner. Each regenerator 18, 20 contains a ceramic bed (not shown) having a matrix of highly heat-absorbent material. In operation, the regenerator 18 preheats unburnt fumes 60 while the burner 14 is in the firing mode, and the regenerator 20 extracts heat from oxidized fumes 70 while the burner 16 is in the exhaust mode. The flow through the apparatus 10 is periodically reversed, with the regenerator 20 preheating unburnt fumes and the regenerator 18 extracting heat from oxidized fumes, as discussed in further detail below.

The bypass 22 is in fluid communication with both the inlet 26 and the incineration chamber 12. A pair of fume bypass valves 48, 50 are positioned at the opposite end of the bypass 22 from the inlet 26. When one of the fume bypass valves 48, 50 is opened, the bypass 22 provides a direct passage for incoming unburnt fumes 60 to a location downstream of the regenerators 18, 20 so that fumes may be introduced directly to the incineration chamber without passing through either regenerator.

The purging device 24 includes a pair of purge conduits 52, 54 and a purge fan 56 in fluid communication with the purge conduits 52, 54. A purge valve 58 selectively admits a purge gas from the purge fan 56 to either one of the purge conduits 52, 54. The purge gas may be either clean air or products of incineration. When clean air is used, it is preferable to include a centrifugal-type purge fan 56, while an axial-type fan is preferred with products of incineration. The purge fan 56 is in fluid communication with the exhaust 28 so that the fan may be continuously run without the need to start and stop every time purging is required.

In operation, unburnt contaminated fumes 60 enter the inlet 26 from an upstream source, such as the finishing line on an aluminum strip coating process. Typical strip coating exhaust contains an unacceptable amount of toluene at less than 15% of its lowest explosive limit. The unburnt fumes 60 then come to a Y-juncture 62 where, by reason of the valve configuration, the unburnt fumes are directed through an inlet valve 64 into the regenerator 18 as shown in FIG. 1. Particularly, the fume bypass valves 48, 50 are closed as is an inlet valve 66. The unburnt fumes 60 typically enter the inlet 26 at a temperature of approximately 100°–400° F. In the regenerator 18, the temperature of the unburnt fumes 60 is raised so that preheated fumes 68 exit the regenerator 18 at approximately 1300°–1400° F. The flow of preheated fumes is then split by the varying diameters of the conduits 53, 55 appending the duct inlet 46 and the plenum inlet 51. Thus, a first portion of the preheated fumes 68 enters the incineration chamber 12 through the duct 30, and a second portion enters the plenum 47 to be introduced to the incineration chamber 12 through the apertures 49.

The preheated fumes 68 are then oxidized in the incineration chamber 12 by the burner 14. Specifically, volatile organic compounds ("VOCs"), mainly hydrocarbon emissions such as toluene, are oxidized to carbon dioxide and water. To achieve thorough incineration of all VOCs, it is desirable to maintain a temperature of approximately 1600° F. within the incineration chamber, while maintaining the fumes within the regenerator for a one-half second residence time. Separate combustion air need not be fed to the burners 14, 16 as long as the fumes 68 contain a minimum of 16% oxygen.

Oxidized fumes 70 exit the incineration chamber 12 through the burner 16. They enter the regenerator 20 at approximately 1600° F. and exit the regenerator as coooled fumes 72 at approximately 300° F. Thus, the bulk of the heat in the oxidized fumes 70 is absorbed by the ceramic matrix material in the regenerator 20. The cooled fumes 72 are then suitable for emission to the atmosphere through the exhaust 28.

As shown in FIG. 1 the purge gas 57 flows through purge conduit 52 and mixes with the cooled fumes 72 in the exhaust. Thus, the purge fan 56 may be continuously operated. The first cycle lasts approximately 20–30 seconds, or until the ceramic bed in the second regenerator 20 has reached a predetermined maximum temperature. At this time, flow through the apparatus 10 is ready to be reversed in accordance with conventional regenerative burner practice.

Figure 2:
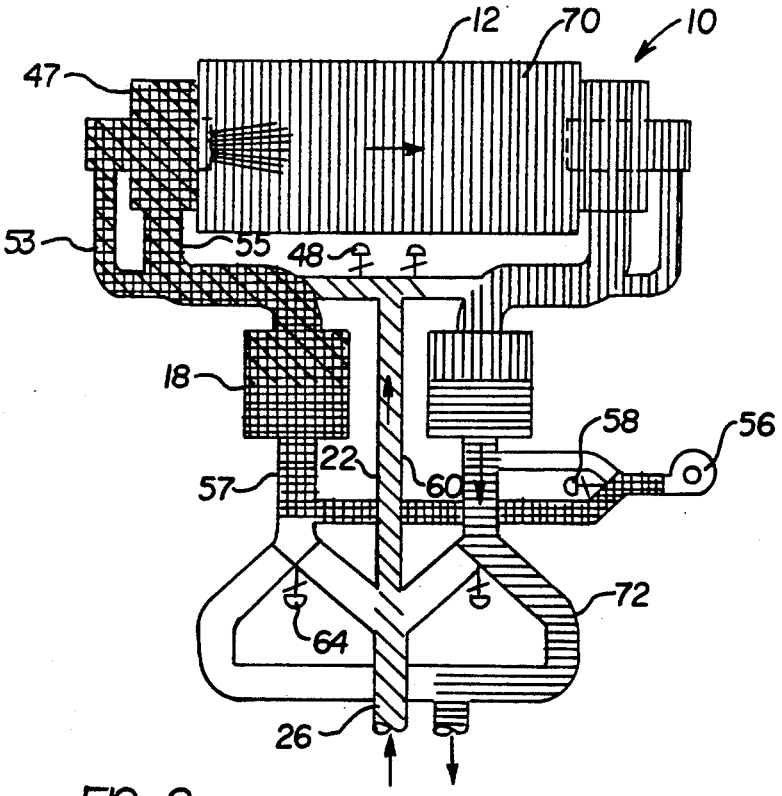
FIG. 2 is a schematic view of the system of FIG. 1 operating in a first purge cycle.

Referring to FIG. 2, a first purge cycle is schematically represented. The first purge cycle immediately follows the first cycle and precedes reversal of flow through the apparatus 10. The inlet valve 64 is closed while the fumes bypass valve 48 is opened so that the unburnt fumes 60 are directed around the regenerator 18 without passing therethrough. Simultaneously, the purge valve 58 is actuated to direct purge gas 57 from the purge fan 56 into the purge conduit 54, which is in fluid communication with the regenerator 18. The purge gas 57 enters the ceramic bed of the regenerator 18 and pushes the residual unburnt fumes from the bed. Additionally, the purge gas 57 is itself preheated within the regenerator 18 so that the thermal efficiency of the apparatus 10 is not substantially compromised, even during the purge cycle. To further adjust for loss of heat due to bypassing of the unburnt fumes, the firing rate of the burner 14 may be adjusted upward during the first purge cycle to maintain temperatures within the incineration chamber 12.

The purge gas 57 and the unburnt fumes 60 mix downstream of the first regenerator 18, thereby raising the temperature of the bypassed unburnt fumes 60. As stated above, preferably 97.5% of this mixture will enter the plenum 47, and the swirling motion within the plenum serves to further mix the purge gas with the unburnt fumes before they are introduced to the burner 14 through the apertures 49. The purge cycle preferably lasts 2–5 seconds.

Figure 3:
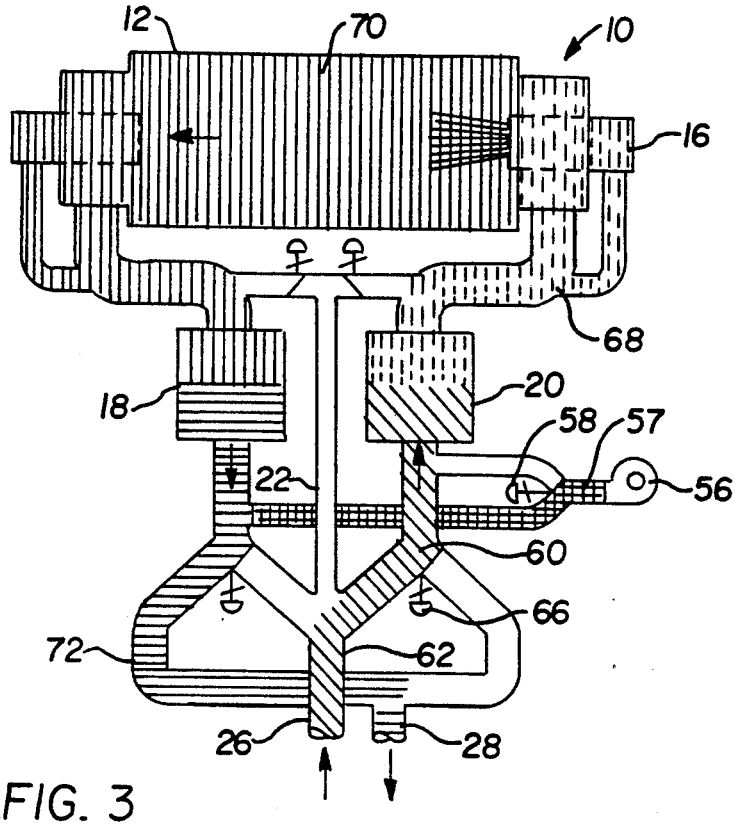
FIG. 3 is a schematic view of the system of FIG. 1 operating in a second cycle.
Figure 4:
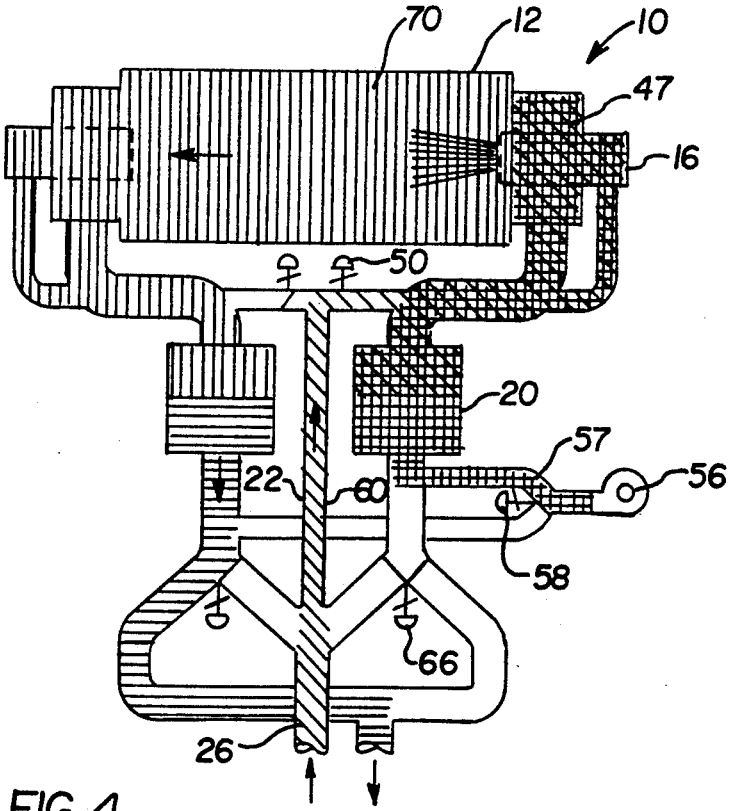
FIG. 4 is a schematic view of the system of FIG. 3 operating in a second purge cycle.

Referring to FIG. 3, after the unburnt fumes 60 have been completely purged from the first regenerator 18 and oxidized by the first burner 14, the flow through the apparatus 10 is reversed by simultaneous closure of fume bypass valve 48 and opening of inlet valve 66. Thus, a second cycle is initiated which is basically a mirror image of the first cycle, discussed above. Again, after 20–30 seconds or until the regenerator 18 has reached a predetermined maximum temperature, a second purge cycle, depicted in FIG. 4, is initiated. The inlet valve 66 is closed while the fume bypass valve 50 is opened, and the purge valve 58 is actuated to direct purge gas 57 into the purge conduit 52. The regenerator 20 is purged and the preheated purge gas mixes with the bypassed unburnt fumes 60 substantially as described in connection with the first purge cycle above. The mixture is oxidized in the incineration chamber 12 by burner 16, and the first cycle is reinitiated.

Having described the invention, it will be apparent to those skilled in the art that various modifications may be made thereto without departing from the spirit and scope of this invention as defined in the appended claims.

We claim:

1. An apparatus for oxidizing fumes, comprising:

an incineration chamber; incineration chamber;

a first regenerator in fluid communication with said incineration chamber;

a second regenerator in fluid communication with said incineration chamber;

said first regenerator preheating unburnt fumes prior to oxidation while said second regenerator extracts heat from oxidized fumes in a first cycle;

said second regenerator preheating unburnt fumes prior to oxidation while said first regenerator extracts heat from oxidized fumes in a second cycle, wherein the flow of fumes through said apparatus is reversed;

a bypass in fluid communication with said incineration chamber for introducing unburnt fumes to said incineration chamber during a purge cycle, intermediate said first cycle and said second cycle, without passing the unburnt fumes through said first or second regenerator;

means for selectively directing the unburnt fumes either into said bypass during said purge cycle or into said first or second regenerator during said first or second cycle, respectively; and a purging device for selectively introducing a purge gas to either one of said first or second regenerators during said purge cycle to purge unburnt fumes therefrom and to direct said purged unburnt fumes to said incineration chamber for oxidation.

2. The apparatus of claim 1 wherein said burner includes a concentric duct in fluid communication with said incineration chamber, a port block concentric with said burner and intermediate said burner and said incineration chamber, and an annular plenum having a plurality of apertures radially spaced from the longitudinal axis of said burner, said apertures coterminus with said port block and in fluid communication with said incineration chamber, said burner and said plenum also in fluid communication with said bypass and with either one of said first or second regenerators.

3. The apparatus of claim 2 wherein the ratio of the sum of the cross-sectional areas of said apertures to the cross-sectional area of said duct is approximately 40:1, so that approximately 97.5% by volume of the unburnt fumes and oxygen introduced to said incineration chamber from said bypass or said regenerators will pass through said apertures in said plenum and approximately 2.5% will pass through said burner.

4. The apparatus of claim 1 wherein said purging device includes at least two conduits, each conduit in fluid communication with one of said regenerators, and at least one valve, said valve selectively directing purge gas to either one of said two conduits.

5. The apparatus of claim 4 wherein said purging device includes a purge fan in fluid communication with said conduits.

6. The apparatus of claim 5 wherein said conduits are also in fluid communication with an exhaust so that said purge fan may be continuously operated through said first, purge and second cycles.

7. An apparatus for oxidizing fumes, comprising:

an incineration chamber;

at least one burner directed into said incineration chamber; said burner having a concentric duct and a port block and further having an annular plenum with a plurality of apertures radially spaced from the longitudinal axis of the burner, said apertures coterminus with said port block, placing said plenum in fluid communication with the incineration chamber, wherein a first portion of the fumes is introduced into the incineration chamber through the apertures, and a second portion is introduced through the duct, with the ratio of the first portion to the second portion being substantially equivalent to the ratio of the combined cross-sectional areas of the apertures to the cross-sectional area of the duct;

a first regenerator in fluid communication with the incineration chamber;

a second regenerator in fluid communication with the incineration chamber;

said first regenerator preheating unburnt fumes prior to oxidation while said second regenerator extracts heat from oxidized fumes in a first cycle;

said second regenerator preheating unburnt fumes prior to oxidation while said first regenerator extracts heat from oxidized fumes in a second cycle, wherein the flow of fumes through said apparatus is reversed;

a bypass in fluid communication with said incineration chamber for introducing unburnt fumes to said incineration chamber during the purge cycle, intermediate said first cycle and said second cycle, without passing the unburnt fumes through said first or second regenerator;

means for selectively directing the unburnt fumes either into said bypass during said purge cycle or into said first or second regenerator during said first or second cycle, respectively; and a purging device for selectively introducing a purge gas to either one of said first or second regenerators during said purge cycle to purge unburnt fumes therefrom and to direct said purged, unburnt fumes to said incineration chamber for oxidation.

* * * * *

UNITED STATES PATENT AND TRADEMARK OFFICE

CERTIFICATE OF CORRECTION

PATENT NO. : 5,161,968

DATED : November 10, 1992

INVENTOR(S) : Peter B. Nutcher and Peter J. Waldern

It is certified that error appears in the above-identified patent and that said Letters Patent is hereby corrected as shown below:

Title page, under References Cited OTHER PUBLICATIONS "Procter" should read --Proctor--.

Column 6 Line 15 "coooled" should read --cooled--.

Claim 1 Line 15 Column 7 after "chamber;" (first occurrence) insert a new paragraph beginning with --at least one burner directed into said--.

Signed and Sealed this

Twenty-sixth Day of October, 1993

*Attest:*

Bruce Lehman

BRUCE LEHMAN

*Attesting Officer*

*Commissioner of Patents and Trademarks*